US012806681B2

(12) United States Patent
Goesswein

(10) Patent No.: US 12,806,681 B2
(45) Date of Patent: Nov. 24, 2026

(54) METHOD AND DEVICE FOR LINEAR WINDING OF A RECTANGULAR WIRE

(71) Applicant: Schaeffler Technologies AG & Co. KG, Herzogenaurach (DE)

(72) Inventor: Johannes Goesswein, Heroldsbach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 275 days.

(21) Appl. No.: 18/704,538

(22) PCT Filed: Oct. 20, 2022

(86) PCT No.: PCT/DE2022/100773

§ 371 (c)(1),
(2) Date: Apr. 25, 2024

(87) PCT Pub. No.: WO2023/072334

PCT Pub. Date: May 4, 2023

(65) Prior Publication Data

US 2025/0229317 A1 Jul. 17, 2025

(30) Foreign Application Priority Data

Oct. 25, 2021 (DE) ..... 102021127640.3
Apr. 20, 2022 (DE) ..... 102022109527.4

(51) Int. Cl.
*B21F 3/00* (2006.01)

(52) U.S. Cl.
CPC ..... *B21F 3/00* (2013.01)

(58) Field of Classification Search
CPC ..... H01F 41/061
See application file for complete search history.

(56) References Cited

U.S. PATENT DOCUMENTS

2005/0242227 A1* 11/2005 Takeda ..... H01F 41/082 242/476.7
2008/0136286 A1* 6/2008 Hiramatsu ..... H01F 41/082 29/605
2012/0037264 A1* 2/2012 Sakabe ..... B21C 47/04 29/605

FOREIGN PATENT DOCUMENTS

DE 2649029 A1 5/1977
DE 102008025590 A1 12/2009
JP 2004158653 A 6/2004
JP 2015071485 A 4/2015

* cited by examiner

*Primary Examiner* — William A. Rivera
(74) *Attorney, Agent, or Firm* — Volpe Koenig

(57) ABSTRACT

A method for winding a rectangular wire in a winding space of a coil former or of a winding tool to form a linearly wound coil, wherein the rectangular wire in the winding space is wound in at least one layer in an axial laying direction. Before the coil is wound, a guide device is introduced at least partially into the winding space, and the guide device has, in the laying direction, a stop which delimits the rectangular wire in the laying direction; the guide device is entrained, during the winding process, as the winding of the coil in the laying direction increases; and the guide device is withdrawn from the winding space before the last winding is wound in front of a second lateral stop. A linear winding device for performing the method is disclosed.

9 Claims, 2 Drawing Sheets

METHOD AND DEVICE FOR LINEAR WINDING OF A RECTANGULAR WIRE

CROSS-REFERENCE TO RELATED APPLICATIONS

This application is the U.S. National Phase of PCT Appln. No. PCT/DE2022/100773, filed Oct. 20, 2022, which claims the benefit of German Patent Appln. No. 102021127640.3, filed Oct. 25, 2021, and German Patent Appln. No. 102022109527.4, filed Apr. 20, 2022, the entire disclosures of which are incorporated by reference herein.

TECHNICAL FIELD

The disclosure relates to a method and a device for linear winding of a rectangular wire.

BACKGROUND

Methods and devices for linear winding of coils are well known. Linear winding technology is the generation of an electrical coil or winding by winding a wire onto a component or carrier to be wound, while the component or carrier to be wound is rotated about an axis of rotation, for example on a driven spindle. The wire is continuously fed from a wire store. Initially, the wire is fixed to the component or carrier to be wound, for example by clamping.

At the same time as the rotation, the supplied wire is displaced by means of a linear movement running parallel to the axis of rotation, whereby the wire is laid within the winding space of the component or the carrier to be wound and this winding space gradually fills up. The linear displacement or laying movement is coordinated with the rotation of the component or carrier to be wound, taking into account the wire width, which allows different winding or laying patterns to be created.

The production of linear windings using flat wires, i.e., wires with a rectangular cross-section, can have the advantage with regard to the filling factor of the winding space that the winding space can be filled better with flat wires than with round wires, for example, even if the round wires are wound in an orthocyclic winding, there is a not inconsiderable volume in the winding space that is not filled by the round wires. This can be further optimized by using flat wires if the geometry of the winding space is appropriate.

Particularly when linear winding flat wires and in particular when multi-layer linear winding, when winding in a flat orientation of the wire, the difficulty arises that wire slipping within the winding space is promoted. If the wire is wound in an upright orientation, it may tend to tilt during winding.

DE 10 2008 025 590 A1 provides that for winding a flat wire on a core displaceably guided in a rotationally driven winding tool, a counter bearing is provided and the winding tool and the counter bearing each have a flange, wherein the counter bearing is moved to the winding tool in such a way that a distance is created between the flange of the winding tool and the flange of the counter bearing in which the flat wire to be wound can only be pulled in in an upright position. In this way, the tipping of the wire during the winding of the core is avoided, with the disadvantage that the winding device as a whole has a complicated structure and direct winding of coil formers is not possible because of a flange of the winding space that is necessarily movable at least on one side.

JP 2004 158 653 A provides a winding device for winding flat wire in an upright orientation in that a wire is wound on a non-rotatably arranged winding body by means of a tilt-preventing device which can rotate or move around the winding body and has a roller with a flange which is spring-loaded axially to the winding axis and holds the flat wire down against the flange of the winding body or against the preceding coil of the winding. The tilting prevention device with the hold-down device is offset around the contour of the winding body. In the case of a cylindrical winding body, the tilting prevention device is arranged at a radial distance from the winding axis and can therefore rotate about a cylindrical winding body. In the case of a winding body with a rectangular cross-section or a more complex cross-section, a two-axis linear mobility of the tilting prevention device is provided by means of linear drives. This winding device or such a winding method also means a very complex structure for the winding machine. The winding speed is also limited here due to the acting forces and the possible travel speeds of the actively driven tilting prevention device.

SUMMARY

The object of the disclosure is to provide a structurally simple device for linear winding flat wires in an upright orientation, with which a linear winding with flat wires in an upright orientation can be produced in a short cycle time in a winding process.

The disclosure relates to a method for winding a rectangular wire in a winding space of a coil former or a winding tool to form a linearly wound coil, wherein the rectangular wire in the winding space is wound in at least one layer in an axial laying direction, having the method steps of: feeding the rectangular wire to a lateral contact of the winding space and holding the wire in relation to the coil former or the winding tool; linear winding of the coil by rotating the coil former or the winding tool while forming windings and continuously feeding the rectangular wire from a feed tracked in the laying direction until the last winding of the layer is wound in the laying direction, wherein it is provided according to the disclosure that before winding the coil a guide device is at least partially inserted into the winding space, wherein the guide device has a stop in the laying direction which limits the wire in the laying direction;

the guide device is entrained during winding as the winding of the coil in the laying direction increases; and the guide device is moved out of the winding space before the last winding is wound in front of a second lateral contact.

The method according to the disclosure has the advantage that the respectively wound winding in the laying direction is limited on one side by the lateral contact of the winding space or by the preceding winding and in the other direction by the stop of the guide device or by the second lateral contact. This effectively prevents the wire from tipping in the laying direction towards one of the lateral contacts. The wire is therefore guided in at least three spatial directions, namely in the laying direction on both sides and through the winding base. The winding base is the surface of the coil former or winding tool onto which the rectangular wire is wound or the previous layer of a wound rectangular wire. The guidance can also take place radially in relation to the axis of rotation of the coil former or the winding tool, for example by a guide roller rolling on the winding. In this case, four-sided guidance of the rectangular wire is achieved when winding the coil. The stop can be realized, for example, by a limiting roller, which is arranged next to the guide roller in the laying direction and, relative to the axis of rotation of the coil former or the winding tool, projects radially further into the winding space. It is also conceivable that the stop is represented by a limiting bolt or a pin. It is also conceivable that the stop is radially adjustable in relation to the axis of rotation of the coil former or the winding tool and can be adjusted to the height of the wound rectangular wire. According to a further embodiment, it is provided that there is a stop in front of and behind the guide roller in the laying direction, which is optionally radially adjustable in relation to the axis of rotation of the coil former or the winding tool. In this way, when laying from the first lateral contact to the second lateral contact, the stop can be adjusted radially on the side of the guide roller facing the second lateral contact in the direction of the coil former or the winding tool in order to limit the rectangular wire in the laying direction and at a laying movement from the second lateral contact to the first lateral contact on the side of the guide roller facing the first lateral contact can be adjusted radially in the direction of the coil former or the winding tool in order to limit the rectangular wire in this laying direction.

According to a further variant, it is provided that the guide device has a guide roller which rolls on the rectangular wire and the guide roller of the guide device has a stepped diameter and between the small diameter and the large diameter the stop is provided for the rectangular wire, and wherein the guide roller with the small diameter rolls on the rectangular wire and with the large diameter limits the wire in the laying direction. In this way, the limitation of the rectangular wire in the laying direction is achieved by just one component, which simplifies the method sequence. According to a further embodiment of the method, it is provided that the rectangular wire is fed in an upright orientation with respect to the feed direction.

According to a further development of the method, it is provided that at least one of the wound turns is pressed onto the coil former or the winding tool by means of at least one pressure roller. The additional pressing or forming of the rectangular wire improves the wire system at the edges, in particular on coil bodies or winding tools that are not round in cross-section, but rather rectangular or trapezoidal in shape. It can be provided here that the pressure roller has a width in the laying direction that corresponds to one or a multiple of the wire width. Optionally, the pressure roller can be moved in the laying direction. In a particularly preferred embodiment, the width of the pressure roller corresponds to the width of the winding space between the lateral contacts, whereby all windings with rectangular wires are pressed against the coil former or the winding tool at the same time. In a further preferred embodiment, a further pressure roller is formed along the circumference of the coil former or the winding tool, which also presses the windings onto the coil former or the winding tool.

In a further preferred embodiment of the method, it is provided that fixing rollers are provided in a feed of the wire in front of the guide device, which can be displaced in the laying direction, wherein during winding the guide device follows the fixing rollers in the laying direction. The fixing rollers advantageously achieve a tightening of the rectangular wire to be wound by the fixing rollers exerting friction on the rectangular wire. The fixing rollers have the technical effect of guiding the wire in a defined manner. Particularly when using rectangular wire, tilting of the wire is avoided. Guiding the wire is particularly necessary when linear winding with rectangular wires, as the guide roller is moved linearly and there is a risk of the rectangular wire becoming entangled in the feed. Furthermore, the fixing rollers can have a flange on both sides, wherein the rectangular wires are then limited on four sides by opposing fixing rollers and their flanges. This advantageously results in precise guidance of the wire in relation to the guide device. The tracking of the guide device in the laying direction results in a bias of the rectangular wire in the laying direction, whereby the wire can be positioned exactly in relation to the laying direction by means of the guide device and the stop of the guide device against this bias. In a further development, it can be provided that the guide device and the fixing rollers are moved in parallel and in particular together.

According to a further embodiment of the method, after the guide device has been moved out of the winding space, it is provided that the guide device is turned in relation to the laying direction so that the stop is reversed with respect to the lateral contacts and the rectangular wire and another layer of the coil is wound according to the method. In this way, it is quite easy to create a multi-layer winding. As already explained above, alternatively to reversing the laying direction in a further layer, a stop on one side of the guide device can be retracted radially in relation to the axis of rotation of the coil former or the winding tool and a further stop on the other side of the guide device in relation to the axis of rotation of the coil former or the winding tool can be extended radially.

According to a further embodiment of the method, it can be provided that the guide device is resiliently mounted in relation to the coil former or the winding tool or is tracked in a force or path controlled or regulated manner. In particular, in one embodiment of the method it can be provided that the guide roller is resiliently mounted in relation to its rolling point or is tracked in force or path controlled or regulated manner and presses the respective winding against the coil former or the winding tool.

According to a further embodiment of the method, it is provided that the guide roller has a shaping effect on the rectangular wire at least temporarily during unrolling. In this way, the contact of the rectangular wire with the coil former or the winding tool is improved, which has a positive effect on the filling factor of the winding space.

In a further development of the method it can be provided that not just one, but multiple rectangular wires is fed and wound at the same time. In a preferred embodiment, the stop limits the outermost rectangular wire in the laying direction.

The disclosure further relates to a linear winding device for carrying out the method described above, having a rotatably driven winding tool or a rotatably driven carrier for receiving a coil former, wherein the device is provided for winding a rectangular wire fed to the device in a feed direction from a feed in a linear winding method of a laying direction in the winding space of the coil former or the winding tool, wherein according to the disclosure it is provided that the device has a guide device movable in the laying direction for guiding the rectangular wire in the winding space, wherein the guide device guiding the rectangular wire in the laying direction has a limiting stop, and the guide device is resiliently mounted in relation to the coil former or the winding tool or is movable in a force or path controlled or regulated manner.

According to a further embodiment of the device, it can be provided that the guide device has a guide roller which rolls on the rectangular wire and the guide roller, wherein the guide roller can be resiliently mounted or designed to be movable in a path controlled or regulated manner in relation to its rolling point on the rectangular wire. According to a further advantageous embodiment, it can be provided that the guide roller is designed with a radial offset forming the stop, wherein a first diameter of the guide roller rolls on the rectangular wire and a second diameter of the guide roller limits the rectangular wire in the laying direction, wherein the first diameter is smaller than the second diameter and the radial offset is less than or equal to the height of the supplied rectangular wire.

For a correspondingly designed device, the advantages already described above for the method are achieved. The stop prevents the rectangular wire from tilting in the laying direction. This can be achieved, for example, by the stepped design of the guide roller on the guide device described above, which results in a limitation of the wire in four spatial directions, namely laterally by the guide roller and the preceding winding or the lateral contact of the winding space and, in relation to the axis of rotation of the coil former or the winding tool, seen radially through the winding base or the previous layer and through the guide roller rolling on the winding. In an alternative embodiment, it is provided that no guide rollers roll on the respective winding and that there is no limitation radially outward relative to the axis of rotation, but only the one lateral limitation by the stop and the previous winding or the lateral contact of the winding space is achieved by the winding base or the previous layer. This can also effectively prevent the rectangular wire from tilting during the production of the winding, resulting in simpler design effort.

According to a further development of the linear winding device, it results that the guide device can be turned in relation to the laying direction, so that the stop of the guide device rests on the supplied rectangular wire when the laying direction is reversed in the laying direction. In this way it is advantageously possible for multiple layers to be wound with the device.

According to a further embodiment of the device, it is provided that the device has a pressure roller for pressing the supplied rectangular wire. The additional pressing or forming of the rectangular wire improves the wire system at the edges, in particular on coil bodies or winding tools that are not round in cross-section, but rather rectangular or trapezoidal in shape. It can be provided here that the pressure roller has a width in the laying direction that corresponds to one or a multiple of the wire width. Optionally, the pressure roller can be moved in the laying direction. In a particularly preferred embodiment, the width of the pressure roller corresponds to the width of the winding space between the lateral contacts, whereby all windings with rectangular wires are pressed against the coil former or the winding tool at the same time. In a further preferred embodiment, a further pressure roller is formed along the circumference of the coil former or the winding tool, which also presses the windings onto the coil former or the winding tool.

In a further development, it can be provided that the guide device and/or the pressure roller are designed to be resilient. This can be done, for example, pneumatically or directly controllable via a separate axis and/or spindle. In this way, the guide device and/or the pressure roller can actively follow the cross-sectional shape of the coil former or the winding tool. In a first embodiment, this is provided as a passive system (e.g., through pneumatics or spring loading). The stop comes into contact with the lateral limitation of the rectangular wire with the winding base. In a further embodiment, this is provided as an active system with a guide device and/or pressure roller that is actively driven in relation to the winding base. In this case, a lateral limitation of the wire does not have to protrude all the way to the winding base. It goes without saying that the guide roller and the pressure roller can be controlled separately.

BRIEF DESCRIPTION OF THE DRAWINGS

Further features, details and advantages of the disclosure result from the wording of the claims and from the following description of exemplary embodiments with reference to the drawings. In the figures:

Unless otherwise stated, the reference signs will be used consistently below. Unless otherwise stated, the reference signs in the text always refer to all figures. Likewise, unless otherwise stated, all reference signs in the figures always refer to the entire description of the exemplary embodiments below.

DETAILED DESCRIPTION

Figure 1:
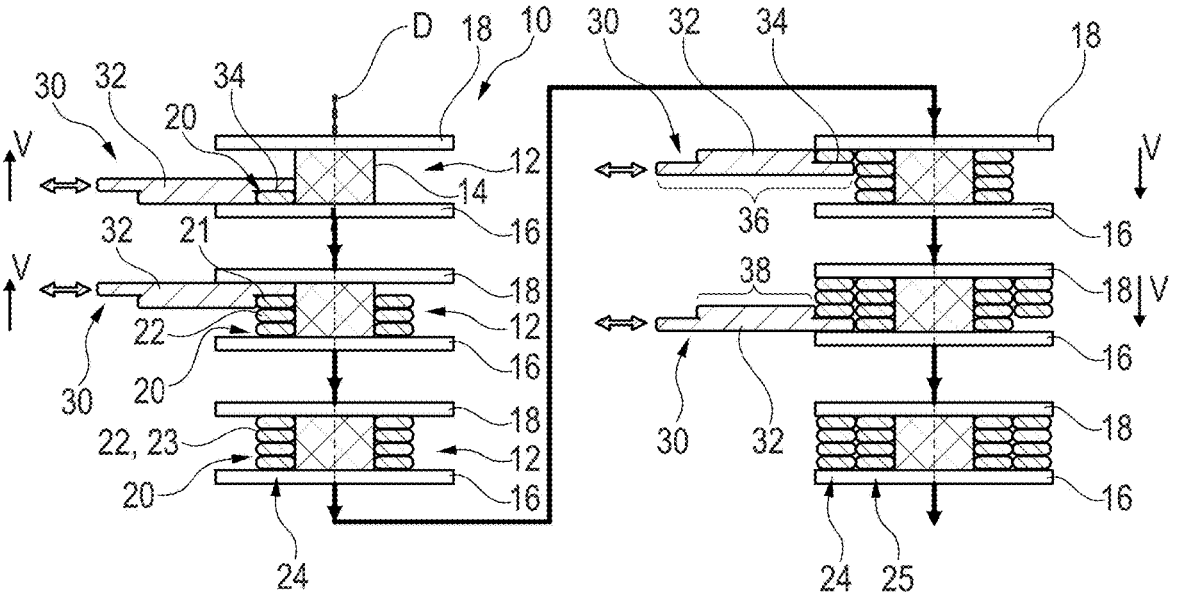
FIG. 1: shows a schematic method sequence for linear winding of a coil winding according to an embodiment of the method with four-sided delimitation of the rectangular wire.
Figure 2:
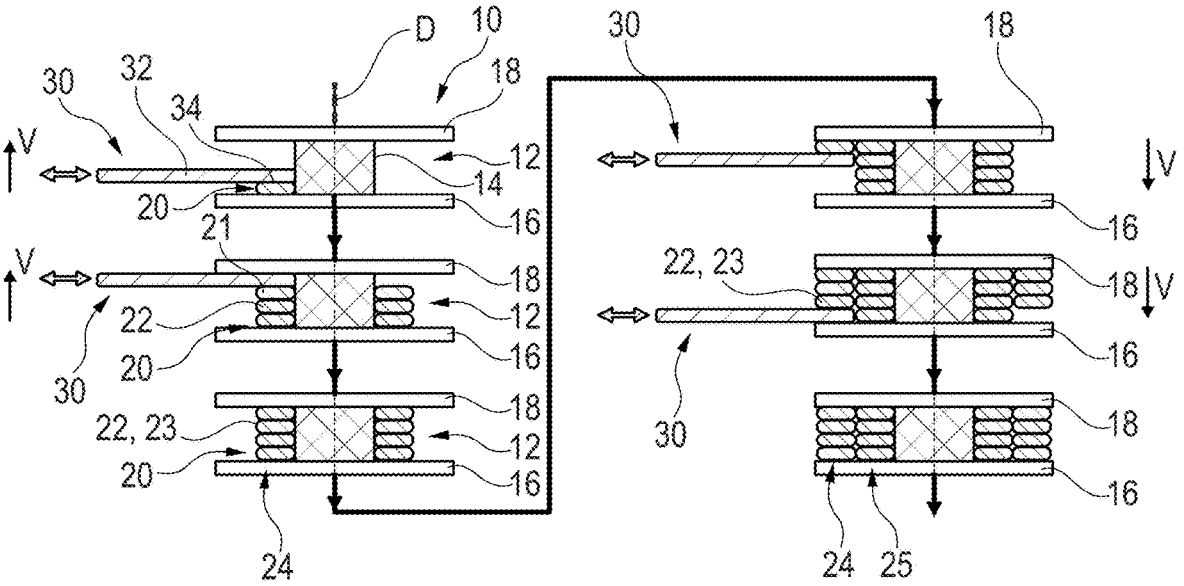
FIG. 2: shows a schematic method sequence for linear winding of a coil winding according to an embodiment of the method with three-sided delimitation of the rectangular wire.

FIGS. 1 and 2 show a schematic method sequence for linear winding of a coil winding according to an embodiment of the method with a four-sided delimitation of the rectangular wire 20 (FIG. 1) and with a three-sided delimitation of the rectangular wire 20 (FIG. 2). A rectangular wire 20 held on a lateral contact 16, 18 of a winding space 12 of a coil former 10 or a winding tool 10 is wound around the coil former 10 or the winding tool 10 according to the linear winding method, in that it is rotatably driven. The rectangular wire 20 is offset in the laying direction V so that a layer 24 of windings 21 of the rectangular wire 20 results in the winding space 12. For the method, it is provided in both embodiments that before winding the coil, a guide device 30 is at least partially inserted into the winding space 12, wherein the guide device 30 has a stop 34 in the laying direction V which limits the rectangular wire 20 in the laying direction V.

In the embodiment according to FIG. 1, the rectangular wire 20 is limited in all spatial directions. In the laying direction V laterally through the first lateral contact 16 of the winding space 12 or through the previous winding 22 as well as through the stop 34 of the guide device 30 and, viewed radially with respect to the axis of rotation D of the coil former 10 or the winding tool 10, through the winding base 14 or the previous layer 25 of the winding and through the guide device 30. For this purpose, the guide device 30 has a guide roller 32 with an offset forming the stop 34, resulting in two diameters 36, 38. With the first, larger diameter 36, the guide roller 32 runs in the winding space 12 next to the retracted winding 21 and limits this in the laying direction V by the stop 34 formed. With the second, smaller diameter 38, the guide roller 32 rolls on the winding 21 of the rectangular wire 20.

The guide device 30 and/or the guide roller 32 is passively mounted with respect to the coil former 10 or the winding tool 10, wherein the guide roller 32 has a bias towards the coil former 10 or the winding tool 10. Alternatively, the guide device 30 and/or the guide roller 32 is actively guided. This can be done, for example, in a force or path controlled or regulated manner. In the case of active guidance, the flange-shaped stop 34 has a radial extent relative to the axis of rotation D of the coil former 10 or the winding tool 10, which is smaller than the height of the rectangular wire 20 or corresponds to the height of the rectangular wire 20. In the case of a passive bias of the rectangular wire 20, the radial extent of the flange-shaped stop 34 is also equal to or less than the height of the rectangular wire.

In the embodiment according to FIG. 2, the rectangular wire 20 is limited in only three spatial directions. In the laying direction V laterally through the lateral contact 16 of the winding space 12 or through the previous winding 22 as well as through the stop 34 of the guide device 30 and, viewed radially with respect to the axis of rotation D of the coil former 10 or the winding tool 10, through the winding base 14 or the previous layer 25 of the winding. In this example, the guide device 30 has a guide roller 32, which forms the lateral stop 34 for the outermost winding 21 of the current position 24 of the coil winding in the laying direction V.

In both exemplary embodiments, the guide device 30 is offset in the laying direction V until the penultimate turn 23 of a layer 24 has been wound and the last winding is ready for to be wound. The guide device 30 is moved out of the winding space 12 and the last winding of the current layer 24 is wound into the winding space 12 between the penultimate winding 23 and the second lateral contact 18 of the winding space 12 and by means of a pressure roller 50 (not in shown in FIGS. 1 and 2).

A new layer 24 is then started on the last winding and the laying direction V is reversed. The guide device 30 is reintroduced into the winding space 12 and in turn forms a stop 34 in the now reversed laying direction V for the rectangular wire 20 lying between the guide device 30 and the second contact 18 of the winding space 12. In the embodiment according to FIG. 1, the special feature is that the guide device 30 must be turned with the offset in the guide roller so that the stop 34 remains facing the rectangular wire.

Subsequently, in both embodiments, the further layer 24 of the coil winding is also wound according to the method described above until the penultimate winding 23 is produced. In principle, any number of layers 24, 25 can be wound. As soon as the penultimate winding of the last layer 24 has been wound, the guide device 30 is moved out of the winding space 12 and the last winding is inserted between the penultimate winding 23 and the respective lateral contact 16, 18.

In both embodiments of the disclosure it can be provided that a pressure roller 50 presses the wound windings 21, 22, 23 in the direction of the winding base 14.

Figure 3:
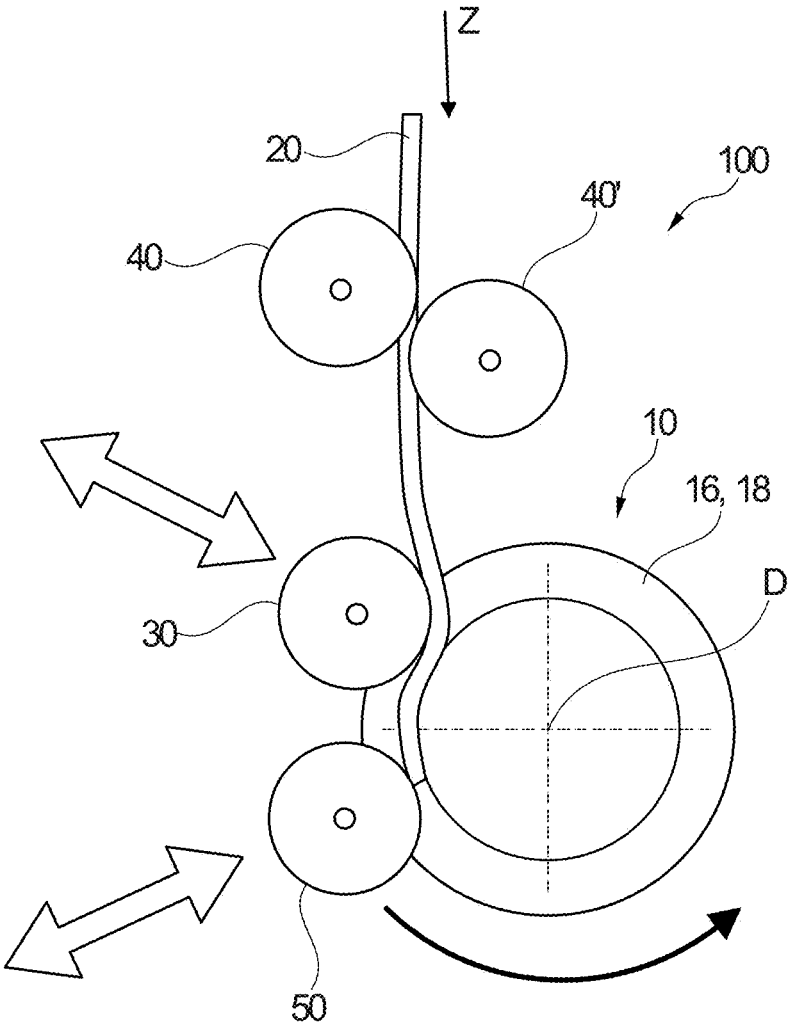
FIG. 3: shows a schematic representation of a linear winding device for carrying out the method.

FIG. 3 shows a schematic representation of a linear winding device 100 for carrying out the method. A rectangular wire 20 is fed to a guide device 30 in a feed direction Z by fixing rollers 40, 40'. The guide device 30 guides the rectangular wire 20 in the winding space 12 of the coil former 10 or the winding tool 10. The rectangular wire 20 is held on a lateral contact 16, 18 of the winding space 12 and wound around the coil former 10 or the winding tool 10 by rotating the coil former 10 or the winding tool 10 about an axis of rotation D. It is understood that the present illustration is only schematic and that there are further components, such as a spindle, which drives the coil former 10 or the winding tool 10. The guide device 30 is movable in a laying direction V running in the plane of the drawing and has a stop 34 which limits the respective wound winding 21 of the rectangular wire 20 in the laying direction V. The guide device 30 is resiliently mounted in relation to the coil former 10 or the winding tool 10 or is movable in a force or path controlled or regulated manner. The linear winding device 100 also has a pressure roller 50 for pressing the supplied rectangular wire 20, which, like the guide device 30, is resiliently mounted in relation to the coil former 10 or the winding tool 10 or is movable in a force or path controlled or regulated manner.

All of the features and advantages resulting from the claims, description and drawings, including structural details, spatial arrangements and method steps, may be essential to the disclosure either alone or in various combinations.

LIST OF REFERENCE SIGNS

10 Coil former, winding tool
12 Winding space
14 Winding base
16 First lateral contact
18 Second lateral contact
20 Rectangular wire
21 Winding
22 Preceding winding
23 Penultimate winding
24 Layer
25 Penultimate layer
30 Guide device
32 Guide roller
34 Stop
36 First diameter
38 Second diameter
40, 40' Fixing roller
50 Pressure roller
100 Linear winding device
V Laying direction
H Height
D Axis of rotation
Z Feed direction

The invention claimed is:

1. A method for winding a rectangular wire in a winding space of a coil former to form a linearly wound coil, wherein the rectangular wire in the winding space is wound in at least one layer in an axial laying direction, having the method steps of:

providing a linear winding device including a rotatably driven carrier for receiving a coil former, wherein the device is provided for winding the rectangular wire fed to the device in a feed direction from a feed in a linear winding method of a laying direction in the winding space of the coil former, wherein the device has a guide device movable in the laying direction for guiding the rectangular wire in the winding space, wherein the guide device guiding the rectangular wire in the laying direction has a limiting stop, and the guide device is resiliently mounted in relation to the coil former or is movable in a force or path controlled manner, wherein the guide device has a guide roller which rolls on the rectangular wire and the guide roller of the guide device has a stepped diameter and between a small diameter and a large diameter the stop is provided for the rectangular wire, and wherein the guide roller with the small diameter rolls on the rectangular wire and with the large diameter limits the rectangular wire in the laying direction;

feeding the rectangular wire to a lateral contact of the winding space and holding the wire in relation to the coil former;

linear winding of the coil by rotating the coil former while forming windings and continuously feeding the rectangular wire from a feed tracked in the laying direction until the last winding of the layer is wound in the laying direction;

wherein a) before winding the coil, the guide device is at least partially inserted into the winding space;

b) the guide device is entrained during winding as the winding of the coil in the laying direction increases; and c) the guide device is moved out of the winding space before the last winding is wound in front of a second lateral contact.

2. The method according to claim 1, wherein at least one of the windings is pressed against a winding base by means of at least one pressure roller.

3. The method according to claim 1, wherein fixing rollers are provided in a feed of the wire in front of the guide device, which are displaceable in the laying direction, wherein during winding the guide device follows the fixing rollers in the laying direction.

4. The method according to claim 1, wherein the guide device is turned after step c) in relation to the laying direction, so that the stop is reversed with respect to the lateral contacts and the rectangular wire and another layer of the coil is wound according to the method.

5. The method according to claim 1, wherein the guide roller has a reshaping effect on the rectangular wire at least temporarily during unwinding.

6. A linear winding device for winding a rectangular wire in at least one layer in an axial laying direction in a winding space of a coil former to form a linearly wound coil, the device having a rotatably driven carrier for receiving a coil former, wherein the device is provided for winding the rectangular wire fed to the device in a feed direction from a feed in a linear winding method of a laying direction in the winding space of the coil former, wherein the device has a guide device movable in the laying direction for guiding the rectangular wire in the winding space, wherein the guide device guiding the rectangular wire in the laying direction has a limiting stop, and the guide device is resiliently mounted in relation to the coil former or is movable in a force or path controlled manner, and wherein the guide device has a guide roller which rolls on the rectangular wire and the guide roller of the guide device has a stepped diameter and between a small diameter and a large diameter the stop is provided for the rectangular wire, and wherein the guide roller with the small diameter rolls on the rectangular wire and with the large diameter limits the rectangular wire in the laying direction.

7. The linear winding device according to claim 6, wherein the guide device is turnable with respect to the laying direction so that the stop of the guide device is in the laying direction when the laying direction is reversed rests on the supplied rectangular wire.

8. The linear winding device according to claim 6, wherein the device has at least one pressure roller for pressing the supplied rectangular wire.

9. A linear winding device for winding a rectangular wire in at least one layer in an axial laying direction in a winding space of a coil former to form a linearly wound coil, the device having a rotatably driven carrier for receiving a coil former, wherein the device is provided for winding the rectangular wire fed to the device in a feed direction from a feed in a linear winding method of a laying direction in the winding space of the coil former, wherein the device has a guide device movable in the laying direction for guiding the rectangular wire in the winding space, wherein the guide device guiding the rectangular wire in the laying direction has a limiting stop, and the guide device is resiliently mounted in relation to the coil former or is movable in a force or path controlled manner, and wherein the guide device is turnable in relation to the laying direction to reverse the stop with respect to the lateral contacts and the rectangular wire for winding another layer of the coil.

* * * * *